United States Patent [19]

Lohmann

[11] 4,047,612

[45] Sept. 13, 1977

[54] NOVEL PACKAGING AND SUPPORTING MEANS FOR FLAT GLASS PANELS

[75] Inventor: Larry John Lohmann, Toledo, Ohio

[73] Assignee: Owens-Illinois, Inc., Toledo, Ohio

[21] Appl. No.: 367,257

[22] Filed: June 5, 1973

[51] Int. Cl.[2] ..... B65D 85/42; B65D 81/02

[52] U.S. Cl. ..... 206/454; 206/521; 206/328

[58] Field of Search ..... 206/456, 455, 454, 453, 206/449, 328, 329, 316, 521, 451, 452, 45.31; 52/40; 315/169 R; 313/220

[56] References Cited

U.S. PATENT DOCUMENTS

| | | | |
|---|---|---|---|
| 764,273 | 7/1904 | Denton et al. | 206/449 |
| 1,669,214 | 5/1928 | Schulz | 206/452 |
| 1,865,485 | 7/1932 | Sas | 206/453 |
| 2,292,279 | 8/1942 | Marton | 206/316 |
| 2,780,348 | 2/1957 | Harter et al. | 206/316 |
| 2,809,728 | 10/1957 | Olson | 52/400 |
| 3,344,917 | 10/1967 | Raffet | 206/451 |
| 3,385,426 | 5/1968 | May et al. | 206/329 |
| 3,605,999 | 9/1971 | Coon, Jr. | 206/328 |
| 3,615,006 | 10/1971 | Freed | 206/328 |
| 3,786,474 | 1/1974 | Miller | 315/169 R |

*Primary Examiner*—William T. Dixson, Jr.
*Attorney, Agent, or Firm*—Donald Keith Wedding

[57] ABSTRACT

There is disclosed a novel packaging means for a display panel. More especially, there is disclosed a clamping or holding frame for protecting the outer edges and corners of a display panel.

3 Claims, 3 Drawing Figures

NOVEL PACKAGING AND SUPPORTING MEANS FOR FLAT GLASS PANELS

THE INVENTION:

This invention relates to the packaging of a display panel, especially a display panel having a pair of glass substrates as disclosed in U.S. Pat. No. 3,499,167 issued to Baker et al. Other display panels of the type contemplated in the practice of this invention include U.S. Design Pat. Nos. 222,543; 222,884; and 224,111. As shown in Baker et al U.S. Pat. No. 3,499,167 and U.S. Design Pat. No. 224,111, such panels are constituted by a pair of support plates, typically one quarter inch thick plate glass, sealed together by a ribbon of glass, the ribbon of glass defining the perimeter of the active gas discharge area. The glass plates are generally flat and rectangular so that when sealed together by the ribbon of glass in a display panel assembly, at least one lateral edge of each plate extends beyond the side edge of the opposite plate and in the usual commercially available panel structure both lateral edges extend beyond both side edges for the purposes of making electrical connections to the conductor arrays in such panels.

In the shipping of the panel it is common for the corners and/or edges of the glass substrate to crack or break.

In accordance with the present invention there is provided a pair of compression applied frames. More especially, a pair of frames designed to protect the outer extremities of the glass substrates, or compression applied on opposite sides of the panel and clamped or otherwise fastened together. The clamping is preferably done over the sealing area of the device; that is, at the perimeter of the active gas discharge area where the glass substrates are sealed together by a ribbon of solder glass. Usually one clamp in each corner of the perimeter will suffice. However, additional clamps may be used.

Figure 1:
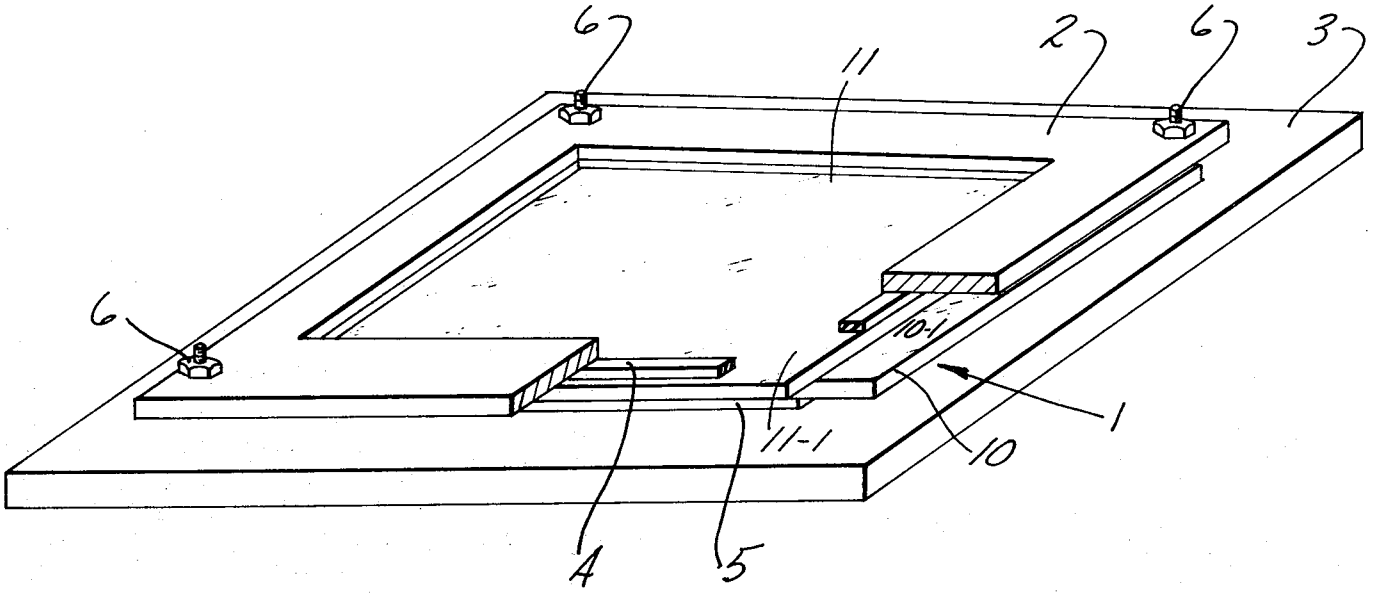
Figure 2:
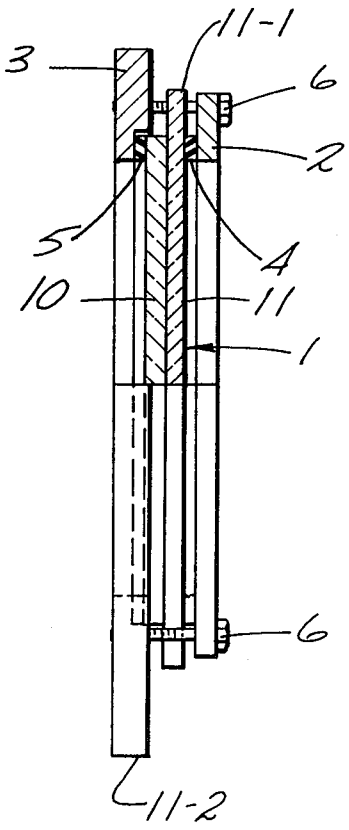
Figure 3:
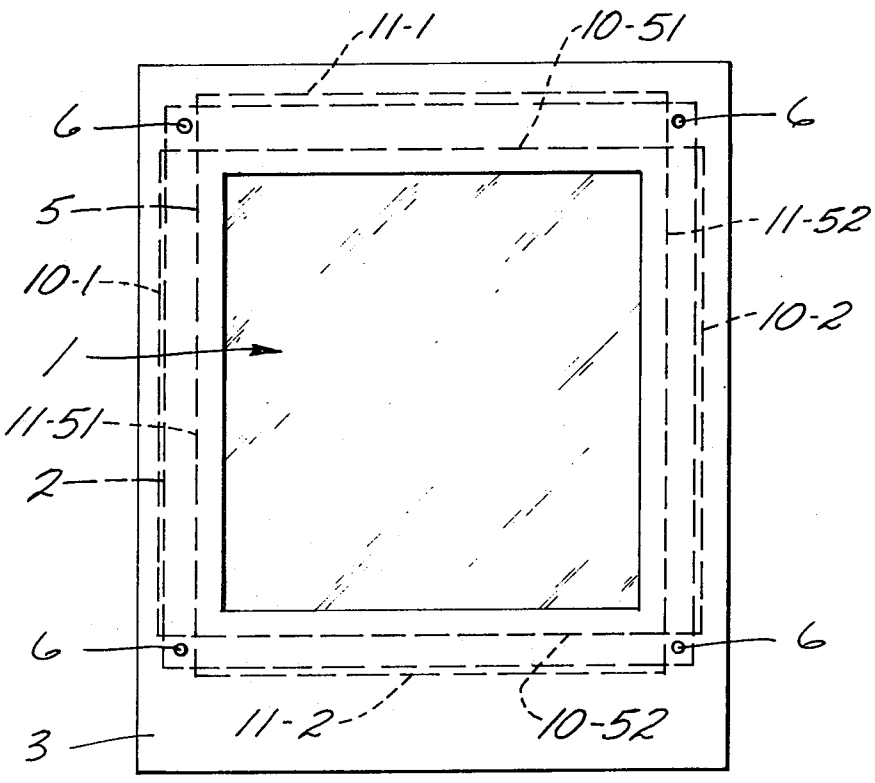

FIG. 1 is a partially cut-away isometric view of a structure incorporating the invention, showing a display panel of the Baker et al patent supported thereby, FIG. 2 is a plan view of the invention showing such a panel in outline form as supported by the structure of the present invention, and FIG. 3 is a partially cut-away side view showing the panel assembly and its relationship to the protective structure of the instant invention.

In FIGS. 1, 2 and 3 there is disclosed a display panel 1, a back clamp 2, a front holder 3, a gasket 4 positioned over the panel seal area in the front, gasket 5 positioned over the panel seal area in the back and four clamping screws 6.

As shown, the display panel 1 has a pair of glass plates 10 and 11 transversely oriented with respect to each other so that the lateral edges 10-1 and 10-2, respectively, of plate 10 extend beyond side edges 11-S1 and 11-S2 of plate 11. In like manner, the lateral edges 11-1 and 11-2 of plate 11 extend beyond the side edges 10-S1 and 10-S2 of plate 10. As shown in the plan view of FIG. 2, the front holder 3 is somewhat larger than the lateral dimensions of either plate. In addition, as shown in the partially cut-away side view of FIG. 3, a gasket 5 is received in a recess (unnumbered) in front holder or frame member 3. The center portion of frame or front holder 3 has an opening therein which is co-extensive with the active viewing area of the display device. In like manner, the back clamp or frame member is positioned on the opposite side of panel 1 and in opposed relation to plate 11. A gasket 4 is positioned over the panel seal area. The front gasket 5 and the back gasket 4 are each positioned over the panel seal area and compression is applied via the front holder and back clamp. The clamping screws 6 extend between the front holder or frame element 3 and rear or back clamp 2 at each of the four corners of the panel assembly. It will be noted that the lateral extensions of each plate 10 and 11 when viewed in plan perspective form a corner notch or cut out, in effect, so as to permit these clamping screws to pass therethrough. These screws then apply compressive force via the gasket on each side of the panel. It will be noted that this compressing force is not applied on the lateral extensions but is applied in opposing relation at the perimeter of the active gas discharge area where the glass substrates are sealed together by the ribbon of glass. Since the lateral extensions of each plate, which carries the conductors through the seal area, are spaced from their respective frame members, the ends of these conductors are thereby available for making electrical connections so that the supporting structure of the frame serves a double utility to maintain the panel in a predetermined position as the display screen in a terminal device.

This invention has been of great commercial significance since it permits the mass shipping of panels while maintaining breakage and light damage at a minimum. In addition, one of the frames can be used to attach and maintain the panel in a predetermined position, e.g. as the display screen in a terminal. In other words, in such an embodiment the frame serves as a double utility—the first being to protect the panel and the second to maintain it in a given position.

I claim:

1. As an article of manufacture, a pair of frames adapted to be positioned on opposite sides of a glass display panel constituted by a pair of transverse glass plates joined by a ribbon of glass, the open center portion of each frame corresponding to the active viewing area of the display device bounded by said ribbon of glass, and means for fastening the two frames together in a compressive force relationship so as to protect the glass corners and edges of the display device each said frame having a panel engaging means, each said panel engaging means and said ribbon of glass being aligned in the direction of said compressive force, whereby said display panel is supported solely between said panel engaging means only at said ribbon of glass thereby protecting the outer edges of the display panel from cracking and/or breaking.

2. The invention defined in claim 1 wherein each said panel engaging means is constituted by a gasket having a perimetrical outline overlying said ribbon of glass.

3. A packaging assembly for a gas discharge display panel of the type having a pair of flat glass substrate members joined together by a ribbon of glass, said ribbon of glass framing the active gas discharge area of said display panel, comprising in combination a pair of frame members one for each side of said display panel, each frame having an open center portion corresponding to the active viewing area of said display panel, a pair of gasket members, one gasket between each frame member its facing external panel surface and aligned with said ribbon of glass, and means fastening said frames together in compression relationship between said gasket members so as to protect the glass corners and edges of said display panel.

* * * * *